US005643702A

United States Patent [19]

Yu

[11] Patent Number: 5,643,702

[45] Date of Patent: Jul. 1, 1997

[54] MULTILAYERED ELECTROPHOTOGRAPIC IMAGING MEMBER WITH VAPOR DEPOSITED GENERATOR LAYER AND IMPROVED ADHESIVE LAYER

[75] Inventor: Robert C. U. Yu, Webster, N.Y.

[73] Assignee: Xerox Corporation, Stamford, Conn.

[21] Appl. No.: 587,118

[22] Filed: Jan. 11, 1996

[51] Int. Cl.[6] ..... G03G 5/047; G03G 5/14

[52] U.S. Cl. ..... 430/58; 430/60; 430/64; 430/131

[58] Field of Search ..... 430/58, 60, 64, 430/131

[56] References Cited

U.S. PATENT DOCUMENTS

| | | | |
|---|---|---|---|
| 4,187,104 | 2/1980 | Tutihasi | 430/128 |
| 4,464,450 | 8/1984 | Teuscher | 430/59 |
| 4,587,189 | 5/1986 | Hor et al. | 430/59 |
| 4,786,570 | 11/1988 | Yu et al. | 430/58 |
| 4,925,760 | 5/1990 | Baranyi et al. | 430/59 |
| 4,943,508 | 7/1990 | Yu | 430/129 |
| 5,089,364 | 2/1992 | Lee et al. | 430/58 |
| 5,288,584 | 2/1994 | Yu | 430/128 |
| 5,322,755 | 6/1994 | Allen et al. | 430/96 |
| 5,378,566 | 1/1995 | Yu | 430/58 |
| 5,400,126 | 3/1995 | Cahill et al. | 430/126 |
| 5,418,100 | 5/1995 | Yu | 430/58 |

*Primary Examiner*—Roland Martin

[57] ABSTRACT

An electrophotographic imaging member comprising an electrophotographic imaging member comprising a substrate layer having an electrically conductive outer surface, an adhesive layer comprising a thermoplastic polyurethane film forming resin, a thin vapor deposited charge generating layer consisting essentially of a thin homogeneous vacuum sublimation deposited film of an organic photogenerating pigment, and a charge transport layer, the transport layer being substantially non-absorbing in the spectral region at which the charge generation layer generates and injects photogenerated holes but being capable of supporting the injection of photogenerated holes from the charge generation layer and transporting the holes through the charge transport layer.

21 Claims, No Drawings

MULTILAYERED ELECTROPHOTOGRAPIC IMAGING MEMBER WITH VAPOR DEPOSITED GENERATOR LAYER AND IMPROVED ADHESIVE LAYER

BACKGROUND OF THE INVENTION

This invention relates in general to electrophotography and more specifically, to an improved electrophotographic imaging member with vapor deposited generator layer and improved adhesive layer and process for using the imaging member.

In the art of electrophotography an electrophotographic plate comprising a photoconductive insulating layer on a conductive layer is imaged by first uniformly electrostatically charging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Flexible electrophotographic imaging member belts are usually multilayered photoreceptors that comprise a substrate, an electrically conductive layer, an optional hole blocking layer, an adhesive layer, a charge generating layer, a charge transport layer and, in some embodiments, an anti-curl backing layer. One type of multilayered photoreceptor comprises a layer of finely divided particles of a photoconductive inorganic compound dispersed in an electrically insulating organic resin binder. U.S. Pat. No. 4,265,990 discloses a layered photoreceptor having separate charge generating (photogenerating) and charge transport layers. The charge generating layer is capable of photogenerating holes and injecting the photogenerated holes into the charge transport layer.

One type of popular photoreceptor is a flexible belt photoreceptor which comprises a thin metal coating ground layer over a flexible polymeric substrate support and two electrically operative layers, including a charge generating layer and a charge transport layer. The electrically conductive ground layer may be formed, for example, on a flexible biaxially oriented substrate by a suitable coating technique, such as vacuum deposition of metals.

After formation of an electrically conductive ground plane, a hole blocking layer may be applied thereto. Where the metallic ground plane is metallic, the hole blocking layer may comprise polyvinylbutyral; organosilanes; epoxy resins; polyesters; polyamides; polyurethanes; pyroxyline vinylidene chloride resin; silicone resins; fluorocarbon resins and the like containing an organo metallic salt; and nitrogen containing siloxanes or nitrogen containing titanium compounds and the like.

In some cases, an intermediate layer between the charge blocking layer and the adjacent generator layer may be used in the photoreceptor to improve adhesion or to act as an electrical barrier layer. Typical adhesive layers disclosed, for example, in U.S. Pat. No. 4,780,385 include film-forming polymers such as polyester, polyvinylbutyral, polyvinylpyrolidone, polyurethane, polycarbonates, polymethylmethacrylate, mixtures thereof, and the like.

The photogenerating layer utilized in multilayered photoreceptors include, for example, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal free phthalocyanine, metal phthalocyanines such as vanadyl phthalocyanine and copper phthalocyanine, quinacidones available from DuPont under the tradename Monastral Red, Monastral violet and Monastral Red Y, Vat orange 1 and Vat Orange 3 trade names for dibromo anthanthrone pigments, benzimidazole perylene, substituted 2,4-diaminotriazines, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189. Other suitable photogenerating materials known in the art can be utilized, if desired. Charge generating binder layers can be used. These binder layers comprise photoconductive particles dispersed in a binder resin such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof in a selected polymer matrix.

Although excellent images may be obtained with multilayered photoreceptors, it has also been found that for certain specific combinations of materials in the different layers, adhesion of the various layers under certain manufacturing conditions can fail and result in delamination of the layers during or after fabrication. Photoreceptor life can be shortened if the photoreceptor is extensively image cycled over small diameter rollers. Also, during extensive cycling, many belts exhibit undesirable dark decay and cycle down characteristics. The expression "dark decay" as employed herein is defined as the loss of applied voltage from the photoreceptor in the absence of light exposure. "Cycle down", as utilized herein, is defined as the increase in dark decay with increasing charge/erase cycles of the photoreceptor.

A typical multilayered photoreceptor exhibiting dark decay and cycle down under extensive cycling utilizes a charge generating layer containing trigonal selenium particles dispersed in a film-forming binder. It has also been found that multilayered photoreceptors containing charge generating layers utilizing trigonal selenium particles are relatively insensitive to visible laser diode exposure systems.

As more advanced, higher speed electrophotographic copiers, duplicators and printers were developed, degradation of image quality was encountered during extended cycling. Moreover, complex, highly sophisticated, duplicating and printing systems operating at very high speeds have placed stringent requirements including narrow operating limits on photoreceptors. For example, the layers of many modern photoconductive imaging members must be highly flexible, adhere well to each other, and exhibit predictable electrical characteristics within narrow operating limits to provide excellent toner images over many thousands of cycles.

An encouraging advance in electrophotographic imaging which has emerged in recent years is the successful fabrication of a flexible imaging member which exhibits a nearly ideal capacitive charging characteristic, outstanding photosensitivity, low electrical potential dark decay, and long term electrical cyclic stability. This imaging member employed in belt form usually comprises a substrate, a conductive layer, a solution coated hole blocking layer, a solution coated adhesive layer, a thin vacuum sublimation deposited charge generating layer of pure organic pigment, a solution coated charge transport layer, a solution coated anti-curl layer, and an optional overcoating layer. This type of photoreceptor is described, for example, in U.S. Pat. No. 4,587,189 in which a benzimidazole perylene charge generating layer is formed by vacuum sublimation. This multilayered belt imaging member provides excellent electrical properties and extended life. However, it has been found that this photoreceptor is susceptible to the formation of cracks in the charge generating layer. Since these cracks have an appearance similar to cracks found in dried mud flats, they are often referred to as "mud cracks". These observed mud cracks in the charge generating layer comprise a two dimensional network of cracks. Mud cracking is believed to be the result of built in internal strain due to the vacuum sublimation deposition process and subsequent solvent penetration through the thin charge generating layer. The penetrating solvent dissolves the adhesive layer underneath the generating layer during application of the charge transport layer coating solution. Crack formation in the charge generating layer seriously impacts the versatility of this type of photoreceptor and can reduce the practical value of the photoreceptor. Cracks in charge generating layers not only print out as defects in the final copy, but may also act as strain concentration centers which propagate the cracks into the other electrically operative layer, i.e., the charge transport layer, during dynamic belt cycling in copiers, printers and duplicators. Omission of the solution coated adhesive layer from the flexible electrophotographic imaging member material package and vacuum deposition of the charge generating layer directly on the hole blocking layer has been found to successfully eliminate the charge generating layer mud cracking problem altogether and provide a simplified imaging material structure. Unfortunately, the resulting electrophotographic belt imaging member spontaneously delaminates after only a few hundred cycles of machine testing. The observed premature mechanical failure of the imaging member belt appears to be due to the stress/strain fatiguing conditions induced by flexing over the belt support rollers as well as mechanical interaction with various machine subsystems during imaging, development, image transfer, and belt cleaning.

Although this discussion has focused primarily on photoreceptors with benzimidazole perylene charge generating layers, the appearance of mud cracking is, in fact, a problem photoreceptors described above which utilize a vacuum sublimation deposited charge generation layer.

While the above-described imaging member exhibits desirable electrical characteristics, there is an urgent need to resolve the cracking problem in order to achieve an imaging member capable of forming high quality prints under extended image cycling conditions. It is also important that any solution employed to solve the charge generating layer mud cracking problem does not produce any deleterious electrical or mechanical integrity effects in the modified device.

Thus, there is a continuing need for an electrophotographic imaging member having improved resistance to mud crack formation in the charge generating layer.

INFORMATION DISCLOSURE STATEMENT

U.S. Pat. No. 5,089,364 to Lee et al., issued on Feb. 18, 1992—An electrophotographic imaging member is disclosed which contains a substrate having an electrically conductive surface, a dried continuous adhesive layer comprising a semi-interpenetrating network derived from a coating mixture comprising a blend of a self-crosslinkable polyurethane and a non-self-crosslinkable polyurethane, a thin homogeneous charge generating layer, and a charge transport layer comprising a film forming polymer.

U.S. Pat. No. 4,587,189 to Hor et al., issued May 6, 1986—An improved layered photoresponsive imaging member is disclosed comprised of a supporting substrate; a vacuum evaporated photogenerator layer comprised of a perylene pigment selected from the group consisting of a mixture of bisbenzimidazo(2,1-a-1',2'-b)anthra(2,1,9-def:6,5,10-d'e'f')diisoquinoline-6,11-dione, and bisbenzimidazo(2,1-a:2',1'-a)anthra(2,1,9-def:6,5,10-d'e'f')diisoquinoline-10,21-dione, and N,N'-diphenyl-3,4,9,10-perylenebis(dicarboximide); and an aryl amine hole transport layer comprised of molecules of a specified formula dispersed in a resinous binder.

U.S. Pat. No. 5,322,755 to Allen et al., issued on Jun. 21, 1994—A layered photoconductive imaging member is disclosed comprising a supporting substrate, a photogenerator layer comprising perylene photoconductive pigments dispersed in a resin binder mixture comprising at least two polymers, and a charge transport layer. The resin binder can be, for example, a mixture of polyvinylcarbazole and polycarbonate homopolymer or a mixture of polyvinylcarbazole, polyvinylbutyral and polycarbonate homopolymer or a mixture of polyvinylcarbazole and polyvinylbutyral or a mixture of polyvinylcarbazole and a polyester. An optional adhesive layer is disclosed which can be selected from various polymers such as polyurethane.

U.S. Pat. No. 5,288,584 to Yu, issued Feb. 22, 1994—A process for fabricating a flexible electrophotographic imaging member including providing a flexible substrate including a biaxially oriented thermoplastic polymer web coated with at least one thermoplastic adhesive layer, vapor depositing on the adhesive layer a thin charge generating layer, cooling the charge generating layer to induce strain in the charge generating layer as well as at the interface between the charge generating layer and the substrate, heating the flexible substrate to shrink the biaxially oriented thermoplastic polymer web and substantially remove the strain from the charge generating layer, and forming a layer of a charge transport coating solution on the charge generating layer, the charge transport coating solution including a charge transporting film forming polymer matrix, and solvent for the film forming polymer matrix, and drying the charge transport coating solution.

U.S. Pat. No. 5,418,100 to Yu, issued May 23, 1995—In an electrophotographic imaging device, the solvent used to coat charge transport materials is a solvent to which an underlying adhesive layer is substantially insensitive. The adhesive layer may, for example, be formed of cross-linked film forming polymers which are insoluble in a solvent used to apply the charge transport layer.

U.S. Pat. No. 5,378,566 to Yu, issued Jan. 3, 1995—An electrophotographic imaging member including a substrate, a hole blocking adhesive layer, a charge generating layer and a charge transport layer, the hole blocking adhesive layer including a polyester film forming binder having dispersed therein a particulate reaction product of metal oxide particles and a hydrolyzed reactant selected from the group consisting of a nitrogen containing organo silane, an organotitanate and an organozirconate and mixtures thereof. Preferably, the electrophotographic imaging member is free of any distinct adhesive layer in contiguous contact with the hole blocking adhesive layer. This imaging member may be utilized in an electrophotographic imaging process.

U.S. Pat. No. 4,925,760 to Baranyi et al, issued May 15, 1990—An improved layered photoresponsive imaging member is disclosed comprising a supporting substrate, a vacuum evaporated photogenerator layer comprised of certain pyranthrone pigments including tribromo-8, 16-pyanthrenedione and trichloro-8, 16-pyranthrenedione; and an arylamine hole transport layer comprised of certain arylamine molecules dispersed in a resinous binder.

U.S. Pat. No. 4,786,570 to Yu et el., issued Nov. 22, 1988—A flexible electrophotographic imaging member is disclosed which comprises a flexible substrate having an electrically conductive surface, a hole blocking layer comprising an aminosilane reaction product, an adhesive layer having a thickness between about 200 angstroms and about 900 angstroms consisting essentially of at least one copolyester resin having a specified formula derived from diacids selected from the group consisting of terephthalic acid, isophthalic acid, and mixtures thereof and a diol comprising ethylene glycol, the mole ratio of diacid to diol being 1:1, the number of repeating units equaling a number between about 175 and about 350 and having a $T_g$ of between about 50° C. to about 80° C., the aminosilane also being a reaction product of the amino group of the silane with the —COOH and —OH end groups of the copolyester resin, a charge generation layer comprising a film forming polymeric component, and a diamine hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer. Processes for fabricating and using the flexible electrophotographic imaging member are also disclosed.

U.S. Pat. No. 4,943,508 to Yu, issued Jul. 24, 1990—A process for fabricating an electrophotographic imaging member is disclosed which involves providing an electrically conductive layer, forming an aminosilane reaction product charge blocking layer on the electrically conductive layer, extruding a ribbon of a solution comprising an adhesive polymer dissolved in at least a first solvent on the electrically conductive layer to form a wet adhesive layer, drying the adhesive layer to form a dry continuous coating having a thickness between about 0.08 micrometer (800 angstroms) and about 0.3 micrometer (3,000 angstroms), applying to the dry continuous coating a mixture comprising charge generating particles dispersed in a solution of a binder polymer dissolved in at least a second solvent to form a wet generating layer, the binder polymer being miscible with the adhesive polymer, drying the wet generating layer to remove substantially all of the second solvent, and applying a charge transport layer, the adhesive polymer consisting essentially of a linear saturated copolyester reaction product of ethylene glycol and four diacids wherein the diol is ethylene glycol, the diacids are terephthalic acid, isophthalic acid, adipic acid and azelaic acid, the sole ratio of the terephthalic acid to the isophthalic acid to the adipic acid to the azelaic acid is between about 3.5 and about 4.5 for terephthalic acid; between about 3.5 and about 4.5 isophthalic acid; between about 0.5 and about 1.5 for adipic acid; between about 0.5 and about 1.5 for azelaic acid, the total moles of diacid being in a mole ratio of diacid to ethylene glycol in the copolyester of 1:1, and the $T_g$ of the copolyester resin being between about 32° C. about 50° C.

U.S. Pat. No. 4,464,450 to Teuscher, issued Aug. 7, 1984—An electrostatographic imaging member is disclosed having two electrically operative layers including a charge transport layer and a charge generating layer, the electrically operative layers overlying a siloxane film coated on a metal oxide layer of a metal conductive anode, said siloxane film comprising a reaction product of a hydrolyzed silane having a specified general formula.

CROSS REFERENCE TO RELATED APPLICATIONS

This application is related to the following U.S. patent applications:

U.S. patent application Ser. No. 08/586,470 (Attorney Docket No. D/95064), filed concurrently herewith on Jan. 11, 1996 in the name of Robert C. U. Yu et al., entitled "PHOTORECEPTOR WHICH RESISTS CHARGE DEFICIENT SPOTS", and issued on Jan. 19, 1996 as U.S. Pat. No. 5,576,130—An electrophotographic imaging member comprising a support substrate having an electrically conductive ground plane layer comprising a layer comprising zirconium over a layer comprising titanium, a hole blocking layer, an adhesive layer comprising a thermoplastic polyurethane film forming resin, a charge generation layer comprising perylene or a phthalocyanine particles dispersed in a polycarbonate film forming binder, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

U.S. patent application Ser. No. 08/587,121 (Attorney Docket No. D/95066), filed concurrently herewith on Jan. 11, 1996 in the names of Satchidanand Mishra et al., entitled "ELECTROPHOTOGRAPHIC IMAGING MEMBER WITH IMPROVED UNDERLAYER", and issued on Nov. 5, 1996 as U.S. Pat. No. 5,571,649—An electrophotographic imaging member is disclosed comprising a support substrate having an electrically conductive ground plane layer comprising a layer comprising zirconium over a layer comprising titanium, a hole blocking layer, an adhesive layer comprising a polymer blend comprising a carbazole polymer and a thermoplastic resin selected from the group consisting of copolyester, polyarylate and polyurethane in contiguous contact with said hole blocking layer, a charge generation layer comprising a perylene or a phthalocyanine in contiguous contact with said adhesive layer, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

U.S. patent application Ser. No. 08/587,120 (Attorney Docket No. D/94852), filed concurrently herewith Jan. 11, 1996 in the names of Satchidanand Mishra et al., entitled "MULTILAYERED PHOTORECEPTOR WITH ADHESIVE AND INTERMEDIATE LAYERS" now U.S. Pat. No. 5,591,554—An electrophotographic imaging member is disclosed including a support substrate having an electrically conductive ground plane layer comprising a layer comprising zirconium over a layer comprising titanium a hole blocking layer, an adhesive layer comprising a polyester film forming resin, an intermediate layer in contact with the adhesive layer, the intermediate layer comprising a carbazole polymer, a charge generation layer comprising a perylene or a phthalocyanine, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

U.S. patent application Ser. No. 08/587,119 (Attorney Docket No. D/95065), filed concurrently herewith on Jan. 11, 1996 in the names of Satchidanand Mishra et al., entitled "ELECTROPHOTOGRAPHIC IMAGING MEMBER WITH IMPROVED CHARGE GENERATION LAYER", and issued on Nov. 5, 1996 as U.S. Pat. No. 5,571,647—An electrophotographic imaging member is disclosed including a support substrate having an electrically conductive ground plane layer comprising a layer comprising zirconium over a layer comprising titanium, a hole blocking layer, an adhesive layer comprising a copolyester resin, a charge generation layer comprising a perylene or a phthalocyanine particles dispersed in a film forming resin binder blend, said binder blend consisting essentially of a film forming polyvinyl butyral copolymer and a film forming copolyester, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

U.S. patent application Ser. No. 08/586,469 (Attorney Docket No. D/95068), filed concurrently herewith on Jan. 11, 1996 in the name of Satchidanand Mishra et al., entitled "IMPROVED CHARGE GENERATION LAYER IN AN ELECTROPHOTOGRAPHIC IMAGING MEMBER", and issued on Nov. 5, 1996 as U.S. Pat. No. 5,571,648—An electrophotographic imaging member is disclosed comprising a support substrate having an electrically conductive ground plane layer comprising a layer comprising zirconium over a layer comprising titanium, a hole blocking layer, an adhesive layer comprising a polyester film forming resin, an intermediate layer in contact with the adhesive layer, the intermediate layer comprising a carbazole polymer, a charge generation layer comprising perylene or a phthalocyanine particles dispersed in a polymer binder blend of polycarbonate and carbazole polymer, and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

SUMMARY OF THE INVENTION

It is, therefore, an object of the present invention to provide an improved electrophotographic imaging member which overcomes the above-noted disadvantages.

It is yet another object of the present invention to provide an improved electrophotographic imaging member which resists the formation of cracks in vapor deposited charge generating layers.

It is still another object of the present invention to provide an improved electrophotographic imaging member which exhibits greater resistance to layer delamination.

It is still yet another object of the present invention to provide a structurally simplified electrophotographic imaging member in which an adhesive interface layer provides improved adhesion bond strength to prevent layer delamination and while also functioning as a hole blocking layer.

It is another object of the present invention to provide an improved electrophotographic imaging member which provides excellent electrical properties.

It is yet another object of the present invention to provide an improved electrophotographic imaging member which extends photoelectrical service life.

It is a further object of the present invention to provide a photoconductive imaging member which enables successful lengthwise slitting of wide webs having a charge generation layer comprising a vacuum deposited perylene.

It is still another object of the present invention to provide an electrophotographic imaging member having welded seams that can be buffed or ground without delaminating.

It is also an object of the present invention to provide an improved electrophotographic imaging member which overcomes the problems of the prior art.

The foregoing objects and others are accomplished in accordance with this invention by providing an electrophotographic imaging member comprising an electrophotographic imaging member comprising a substrate layer having an electrically conductive outer surface, an adhesive layer comprising a thermoplastic polyurethane film forming resin, a thin vapor deposited charge generating layer consisting essentially of a thin homogeneous vacuum sublimation deposited film of an organic photogenerating pigment, and a charge transport layer, the transport layer being substantially non-absorbing in the spectral region at which the charge generation layer generates and injects photogenerated holes but being capable of supporting the injection of photogenerated holes from the charge generation layer and transporting the holes through the charge transport layer.

This imaging member is fabricated by providing a flexible substrate layer having an electrically conductive outer surface, forming an adhesive layer comprising a solvent soluble thermoplastic polyurethane film forming resin, vacuum sublimation depositing on the adhesive layer a thin charge generating layer consisting essentially of a thin, uniform homogeneous film of photoconductive pigment, and applying to the charge generating layer a coating comprising a film forming binder and a second solvent for the film forming binder, the polyurethane being insoluble in the second solvent, and drying the coating to form the charge transport layer.

It is believed that in many photoreceptors of the prior art, the origin of the problem associated with mud cracking is caused by the buildup of internal tensile strain in the charge generating layer during vacuum sublimation deposition of the thin charge generating layer onto an adhesive layer in a multilayered imaging device. More specifically, during the vapor deposition process, the organic pigment evaporates at a high temperature from a crucible and condenses onto a flexible substrate comprising a polymeric web coated with a thin metal ground plane, a hole blocking layer and a polyester-adhesive interface layer. A charge transport layer is subsequently coated onto the charge generating layer to form the electrophotographic imaging member which may also have an anti-curl layer on the back side of the substrate support web to ensure that the imaging member remains flat. The thin charge generating layer comprises about 0.65 percent of the flexible supporting substrate thickness. During this vapor deposition process, the condensed charge generating layer remains at an elevated temperature and at a stress/strain free state. The temperature rise in the substrate during the charge generation layer deposition step is very slight because the substrate has a much larger mass than the charge generating layer and also because the substrate is a good heat insulator. A typical mass ratio between the charge generating layer and the substrate is about 1 to 152. As the layers cool to ambient room temperature, two dimensional thermal contraction of the charge generating layer exceeds that of the substrate, and causes the development of internal strain in the charge generating layer.

The polyester adhesives commonly used for the adhesive interface layer coating are highly soluble in methylene chloride, which is a common solvent used in the applying charge transport layer coating solution. Although the vapor deposited charge generating layer is insoluble in the solvent used to apply the charge transport layer, the extremely thin charge generating layer is permeable to solvents used to apply the charge transport layer. This permeability allows the solvent to penetrate through the thin charge generating layer during the charge transport layer coating step. It has been found that penetration of solvent through the charge generating layer is uneven and that this uneven penetration can adversely affect interface bonding between the charge generating layer and the adhesive layer due to irregular solvent dissolution of the adhesive layer. When the adhesive layer fails to uniformly function as a support anchor, the planar internal strain in the vapor deposited charge generating layer is released in an irregular pattern leading to a two dimensional structure of mud cracks. When the adhesive interface layer is eliminated so that the charge generating layer may be sublimated directly onto the hole blocking layer such as a crosslinked amino silane, the mud cracking problem can be overcome. Unfortunately, this leads to poor adhesive bond strength between the charge generating layer and the crosslinked silane hole blocking layer. This poor adhesion bond strength is manifested by spontaneous layer delamination following application of the charge transport layer and drying at an elevated temperature.

The substrate may be opaque or substantially transparent and may comprise numerous suitable materials having the required mechanical properties. Accordingly, this substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like. Preferably, the substrate is in the form of an endless flexible belt and comprises a commercially available biaxially oriented polyester known as Mylar, available from E. I. du Pont de Nemours & Co. or Melinex available from ICI.

The thickness of the substrate layer depends on numerous factors, including economical considerations. Thus, a flexible belt may be of substantial thickness, for example, over 200 micrometers, or of minimum thickness of less than 50 micrometers, provided there are no adverse effects on the final photoconductive device. In one flexible belt embodiment, the thickness of this layer ranges from about 65 micrometers to about 150 micrometers, and preferably from about 75 micrometers to about 125 micrometers for optimum flexibility and minimum stretch when cycled around small diameter rollers, e.g. 19 millimeter diameter rollers.

The electrically conductive ground plane coating may be an electrically conductive metal layer which may be formed, for example, on the flexible biaxially oriented substrate by any suitable coating technique, such as a vacuum sputtering deposition technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer is preferably between about 20 Angstroms and about 750 Angstroms, and more preferably between about 50 Angstroms and about 200 Angstroms for an optimum combination of electrical conductivity, flexibility and light transmission.

Regardless of the technique employed to form the metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a transparent copper iodide (CuI), or a conductive carbon black dispersed in a plastic binder as an opaque conductive layer. A typical electrical conductivity for a conductive layer used for the electrophotgraphic imaging members in slow speed copiers is about $10^2$ to $10^3$ ohms/square.

A hole blocking layer may be applied the ground plane. Generally, electron blocking layers for positively charged photoreceptors allow holes from the imaging surface of the photoreceptor to migrate toward the conductive layer. Thus, an electron blocking layer is normally not expected to block holes in positively charged photoreceptors such as photoreceptors coated with charge generating layer and a hole transport layer. Any suitable hole blocking layer capable of forming an electronic barrier to holes between the adjacent photoconductive layer and the underlying zirconium and/or titanium layer may be utilized. The hole blocking layer may be a nitrogen containing siloxane such as trimethoxysilyl propylene diamine, hydrolyzed trimethoxysilyl propyl ethylene diamine, N-beta(aminoethyl) gamma-amino-propyl trimethoxy silane, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl dimethoxysilane. A preferred blocking layer comprises a reaction product between a hydrolyzed silane and the zirconium and/or titanium oxide layer which inherently forms on the surface of the metal layer when exposed to air after deposition. This combination reduces spots at time 0 and provides electrical stability at low RH. The imaging member is prepared by depositing on the zirconium and/or titanium oxide layer a coating of an aqueous solution of the hydrolyzed silane at a pH between about 4 and about 10, drying the reaction product layer to form a siloxane film and applying electrically operative layers, such as a photogenerator layer and a hole transport layer, to the siloxane film.

The hydrolyzed silane may be prepared by hydrolyzing any suitable amino silane. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof. During hydrolysis of the amino silanes described above, the alkoxy groups are replaced with hydroxyl group.

After drying, the siloxane reaction product film formed from the hydrolyzed silane contains larger molecules. The reaction product of the hydrolyzed silane may be linear, partially crosslinked, a dimer, a trimer, and the like.

Any suitable technique may be utilized to apply the hydrolyzed silane solution to the metal oxide layer of a metallic conductive anode layer. Typical application techniques include spraying, dip coating, roll coating, wire wound rod coating, and the like. Generally, satisfactory results may be achieved when the reaction product of the hydrolyzed silane and metal oxide layer forms a layer having a thickness between about 20 Angstroms and about 2,000 Angstroms.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. This siloxane coating is described in U.S. Pat. No. 4,464,450, the disclosure thereof being incorporated herein in its entirety.

The siloxane hole blocking layer should be continuous and have a thickness of less than about 0.5 micrometer because greater thicknesses may lead to undesirably high residual voltage. A hole blocking layer of between about 0.005 micrometer and about 0.3 micrometer (50 Angstroms–3000 Angstroms) is preferred because charge neutralization after the exposure step is facilitated and optimum electrical performance is achieved. Alternatively, a thickness of between about 0.03 micrometer and about 0.06 micrometer is preferred if a zirconium and/or titanium oxide layer is formed on the metal conductive ground plane to function as a hole blocking layer for optimum electrical behavior and reduced charge deficient spot occurrence and growth.

An intermediate adhesive layer may be interposed between the hole blocking layer below and the charge generation layer above to provide adhesion linkage. Any suitable linear thermoplastic film forming polyurethane resin may be utilized as the adhesive layer of this invention. A typical film forming thermoplastic polyurethane contains predominantly urethane structural linkages between repeating units in the polymer chain. The urethane structural linkages can be represented by the following formula:

$$\left(\text{NH}-\overset{\overset{\text{O}}{\|}}{\text{C}}-\text{O}\right)$$

The urethane linkage are formed by the addition reaction between an organic isocyanate group and an organic hydroxyl group. In order to form a polymer, the organic isocyanate and the hydroxyl group containing compounds must be difunctional.

Generally, polyurethanes can be divided into thermoset and thermoplastic types. The thermoset polyurethane is a crosslinked material in which all the polymer molecules are interconnected to each other through allophanate bonds to form a three-dimensional network of a single giant molecule. The typical property that characterizes a thermoset polyurethane is its insolubility in a thermodynamically good solvent and, once cured, the thermoset polyurethane cannot be molded into a different shape or form. On the other hand, the thermoplastic polyurethane is usually a straight chain molecule and readily soluble in a variety of thermodynamically good solvents.

A preferred thermoplastic film forming polyurethane resin for the adhesive layer application of this invention must be readily soluble in a selected organic solvent or a solvent mixture to form a coating solution; and, once applied onto a substrate surface, the coating solution should form a smooth, homogeneous, uniform layer. Furthermore, the thermoplastic film forming polyurethane resin selected for the adhesive interface layer application is required to be totally insoluble in the solvent used for the subsequently applied charge transport layer coating solution. The insolubility of the selected thermoplastic film forming polyurethane resin in the dried adhesive layer upon exposure to the solvent used in the subsequently applied charge transport layer coating is the key property that resolves the prior art charge generation layer mud cracking problem. The thermoplastic film forming polyurethane resin for the adhesive layer of this invention is a straight chain linear polymer comprising a reaction product of a low molecular weight diol serving as a chain extender, an aromatic diphenyl methane diisocyanate or an aliphatic dicyclohexyl methane diisocyanate, and a linear difunctional polyether or polyester polyol.

The low molecular weight chain extender is generally a difunctional aliphatic oligomer of glycols which is reactive with the isocyanate group of the diphenyl methane diisocyanate. Typical difunctional aliphatic oligomers of glycols include, for example, ethylene glycol, propylene glycol, 1,4 butanediol, 1,6 hexanediol and the like. In the event that a low molecular weight difunctional amine is used as a substitute for the glycol chain extender, the difunctional amine may include, for example, ethylenediamine, toluenediamines, alkyl substituted (hindered) toluenediamines, and the like.

Typical diisocyanates useful for the synthesis of thermoplastic polyurethanes include diphenyl methane diisocyanates such as 4,4'-diphenyl methane diisocyanate, 2,4'-diphenyl methane diisocyanate, and the like. Aliphatic diisocyanates that are also suitable for synthesis of thermoplastic polyurethanes include 4,4'-dicyclohexyl methane diisocyanate, 2,4'-dicyclohexyl methane diisocyanate, and the like.

Suitable difunctional polyether polyols are typically prepared by the oxyalkylation of a dihydric alcohol such as ethylene glycol, propylene glycol, butylene glycol, neopenty glycol, 1,6-hexanediol, hydroquinone, resorcinol, bisphenols, aniline and other aromatic monoamines, aliphatic monoamines and monoesters of glycerine with ethylene oxide, propylene oxide, butylene oxide, and the like. The expression "difunctional" as employed herein is defined as a linear molecule having two-end terminal functional groups that are readily reactive with the diisocyanate during the thermoplastic polyurethane synthesizing process.

The difunctional polyester polyol for polyurethane synthesis may be obtained by simply polymerizing a polycarboxylic diacid or its derivative (e.g. acid chloride or anhydride) with a polyol. Typical polycarboxylic acids suitable for this purpose include malonic acid, citric acid, succinic acid, glutaric acid, adipic acid, pimelic acid, azelaic acid, sebasic acid, maleic acid, fumaric acid, terephthalic acid, phthalic acid and the like. Typical polyols suitable for the preparation of polyester polyols include, for example, trimethylopropane, trimethylolethane, 2-methylglucoside, sorbitol, low molecular weight polyols such as polyoxyethlene glycol, polyoxy propylene glycol and block heteric polyoxyethylene-polyoxpropylene glycols, and the like.

Polyester polyol, the polycaprolactone polyester is, in general, terminated with a low molecular weight diol.

In the polyurethane synthesis reaction, the ratio of the isocyanate group to the total —OH functional groups in both the chain extender diol and the polyol (polyether or polyester) is equal to 1.

The thermoplastic film forming polyurethane resin used in the adhesive layer of this invention can be classified into two basic categories, namely: polyether based polyurethanes and polyester based polyurethanes. Both thermoplastic polyurethanes comprise hard segment and soft segment components in the structure of the molecule backbone. The hard segment is typically formed by the reaction, for example, between 4,4'-diphenyl methane diisocyanate and 1,4-butanediol, while the soft segment is the result of reacting a linear polyether glycol, for example, polytetramethylene ether glycol with 4,4'-diphenyl methane diisocyanate. These hard and soft segments can form a straight chain polyether thermoplastic polyurethane. Although the polyester thermoplastic polyurethane may contain the same hard segment component as that in the backbone of a polyether thermoplastic polyurethane, nevertheless the soft segment of the polyester thermoplastic polyurethane would, for example, be formed from the reaction between 4,4'-diphenyl methane diisocyanate and a polyester glycol, for example, polyadipate tetramethylene glycol. For best results, the weight ratio between the hard segment and the soft segment in the polymer chain of a typical thermoplastic polyurethane for the adhesive layer of this invention is from about 75/25 to about 15/85. A weight ratio beyond 75/25 will produce excessive material crystallinity in the thermoplastic polyurethane, rendering it insoluble in solvents or solvent mixtures normally selected for coating solution preparation. A weight ratio lower than about 15/85 will yield a tacky polyurethane adhesive interface layer which causes the applied coating layer to stick to the backside of the substrate support web after coating/drying and wind up steps employed in the production of electrophotographic imaging member. Optimum results are achieved with a weight ratio between the hard segment and the soft segment of between about 60/40 and about 25/75.

The characteristic reaction leading to the formation of the hard segment, the crystalline domain which provides thermomechanical stability, and the soft segment which is responsible for low temperature behavior as well as chemical properties in the linear thermoplastic polyurethane backbone is shown below:

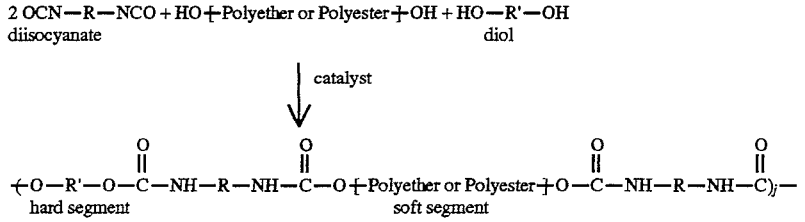

wherein:

R is a diphenyl substituted methylene group or dicyclohexyl substituted methylene group, R' is a straight alkyl chain hydrocarbon containing between 2 and 6 carbon atoms, and J is the degree of polymerization between 90 and 500.

Preferred low molecular weight diol chain extenders may be represented by the following molecular formula:

$$HO\left(CH_2\right)_v\left(O\left(CH_2\right)_v\right)_wOH$$

wherein:

v is a number from 1 to 6 and w is a number from 1 to 4.

A preferred diisocyanate thermoplastic polyurethane resin used for the adhesive interface layer of the present invention is 4,4'-diphenyl methane diisocyanate or 4,4'-dicyclohexyl methane diisocyanate.

The difunctional polyether polyol is represented by the following structural formula:

$$HO\left(CH_2\right)_x\left(O\left(CH_2\right)_x\right)_mOH$$

wherein:

x is a number from 2 to 10 m is a number from 10 to 20.

One embodiment of the difunctional polyester polyol is represented by the following formula:

$$HO\left(CH_2\right)_y\left(O-\overset{O}{\overset{\|}{C}}\left(CH_2\right)_z\overset{O}{\overset{\|}{C}}-O\left(CH_2\right)_y\right)_nOH$$

wherein:

y is a number from 2 and 10, z is a number from 4 to 10, and n is a number from 15 to 30.

Another embodiment of the difunctional polyester polyol is polycaprolactone polyester having diol termination at the both ends of the polyester chain. The molecular structure of this polycaprolactone polyester is represented by the formula below:

$$HO\left(CH_2\right)_yO\left(\left(CH_2\right)_5-\overset{O}{\overset{\|}{C}}-O\right]_n\left(CH_2\right)_yOH$$

wherein:

y is a number from 2 to 10 and n is a number from 15 to 30

Alternatively, the thermoplastic polyurethane film forming resin may be formed from the reaction of a diisocyanate, a difunctional diamine, and a linear difunctional polyol selected from the group consisting of polyether polyol and a polyester polyol.

Typical commercially available linear thermoplastic film forming polyurethane resins substantially free of any cross linking and suitable for the adhesive layer of the electrophotographic imaging member of this invention, include, for example, Elastollan® (available from BASF Corporation ), Texin® and Desmopan® (available from Bayer Corporation), Pellethan® and Isoplast® (available from Dow Chemical Company), and Estane® (available from B F Goodrich Specialty Chemicals). These thermoplastic film forming polyurethane resins, either alone or in a blend, can be used for the adhesive interface layer of this invention. Preferably, the linear thermoplastic film forming polyurethane resins have a weight average molecular weight between about 70,000 and about 170,000 for satisfactory results. If the weight average molecular weight is below about 70,000, the coated adhesive interface layer tends to be too tacky and sticks to the back side of the substrate when the web is roll up. At a weight average molecular weight exceeding about 170,000 the polyurethane tends to be insoluble in the organic solvent or solvent mixtures usually selected for preparation of coating solutions. The linear thermoplastic film forming polyurethane resin employed in the adhesive layer of this invention are soluble in various selected solvents before and after deposition. Any suitable solvent may be employed for preparation of the polyurethane adhesive layer coating solution. Typical solvents for the preparation of coating solutions of linear thermoplastic film forming polyurethane resins include, for example, tetrahydrofuran, methyl ethyl ketone, dimethyl formamide, N-methyl pyrrolidone, dimethyl acetamide, ethyl acetate, pyridine, m-cresol, benzyl alcohol, cyclohexanone, and the like and mixtures thereof. The coating solution formed with the linear thermoplastic film forming polyurethane resin of this invention is free of any cross linkable polyurethane resins because the cross linkable polyurethane resins, being insoluble in the solvent, will form gel particles in the resulting interface layer thereby causing undesirable surface irregularities and protrusions. The linear thermoplastic film forming polyurethane resin selected should be totally insoluble in solvents utilized to apply the charge transport layer coating solution in order to prevent the development of mud cracking problem previously encountered with vacuum sublimation-deposited charge generating layers. Typical solvents in which the linear thermoplastic film forming polyurethane resin is insoluble, but in which typical polymers used for charge transport layer applications are soluble, include, for example, methylene chloride, toluene, benzene, xylene, propane, hexane, cyclohexane, decalin, ether, chloroethane, ethylene chloride, perchloroethylene, trichloroethylene, tetrachloroethylene, chlorobenzene, carbon tetrachloride, and the like and mixtures thereof. The expression "insoluble" as employed herein is defined as a thermodynamic state in which the decrease in free energy due to mixing of polymer and solvent is insufficient to overcome the secondary valence forces that arise from inter and intra molecular interactions when the thermoplastic polyurethane resin is placed in contact with an excess of solvent whereby polymer dissolution into the solvent does not occur. The linear thermoplastic film forming polyurethane resins selected for present invention application are substantially free of any cross linking because no interchain chemical bonds, for example, allophanate bonds, are formed either at the time of polyurethane synthesis, during coating solution preparation, during application of the coating, during drying of the coating, or during fabrication of the other layers of the electrophotographic imaging member.

Surprisingly, the adhesive layer of this invention comprising the linear thermoplastic film forming polyurethane resin provides markedly superior electrical and adhesive properties when employed in combination with a thin vacuum sublimation deposited charge generating layer consisting essentially of a thin homogeneous vapor deposited film of benzimidazole perylene. Also unexpected, is the absence of mud cracking which can be encountered when other common types of adhesive resins, such as the polyester resin 49000 available from Morton Chemicals, are used in the adhesive layer. It has been observed that the adhesive bond between a thin homogeneous vacuum sublimation-deposited film of benzimidazole perylene and the 49000 polyester resin adhesive layer also varies with the degree of mud cracking and that good bond strength is achieved only when extensive mud cracking occurs.

Since the thermoplastic film forming polyurethane resins employed in the adhesive layer of the present invention also can block holes, the layer can be used, in a preferred embodiment, as a replacement for the separate and distinct adhesive and hole blocking layers commonly used in electrophotographic imaging members while still providing excellent photoelectric results. This eliminates the need for two separate layers such as the typical combination of a copolyester adhesive interface layer and a siloxane hole blocking layer. This also eliminates one of two separate coating steps.

Any suitable and conventional techniques may be utilized to mix the thermoplastic polyurethane resin with a selected solvent or solvent mixture to form an adhesive interface layer coating solution and to thereafter apply the solution as a coating. Typical application techniques include, for example, spraying, dip coating, roll coating, wire wound rod coating, and the like. Drying of the deposited coating may be effected by any suitable conventional technique such as oven drying, infra red radiation drying, air drying and the like. Generally, the thickness of the thermoplatic polyurethane adhesive interface layer after drying is between about 0.01 micrometer and about 2 micrometers, but thicknesses outside this range can also be used. A dried thickness of between about 0.03 micrometer and about 1 micrometer is preferred, with optimum results being achieved with a thickness between about 0.05 micrometer and about 0.5 micrometer.

Any suitable continuous, thin vacuum sublimation deposited, homogeneous, organic photogenerating layer may be applied to the adhesive blocking layer of this invention. The photogenerating layer can then be overcoated with a contiguous hole transport layer as described hereinafter. Organic photogenerating layer materials which can be vacuum sublimation deposited include, for example, photoconductive perylene and phthalocyanine pigments, such as benzimidazole perylene, chloroindium phthalocyanine, hydroxygallium phthalocyanine, the X-form of metal free phthalocyanine described in U.S. Pat. No. 3,357,989, vanadyl phthalocyanine, titanyl phthalocyanine, copper phthalocyanine, and the like. Other typical organic photogenerating pigments of interest include, for example, dibromoanthanthrone; squarylium; quinacridones such as those available from du Pont under the tradename Monastral Red, Monastral Violet and Monastral Red Y; dibromo anthanthrone pigments such as those available under the trade names Vat Orange 1 and Vat Orange 3; substituted 2,4-diamino-triazines disclosed in U.S. Pat. No. 3,442,781; polynuclear aromatic quinones such as those available from Allied Chemical Corporation under the tradenames Indofast Double Scarlet, Indofast Violet Lake B, Indofast Brilliant Scarlet and Indofast Orange; and the like. Multi-photogenerating layer compositions may be utilized where a photoconductive layer enhances or reduces the properties of the photogenerating layer. Other suitable photogenerating materials known in the art which can be vacuum sublimation deposited may also be utilized, if desired. Charge generating layers comprising a photoconductive material such as vanadyl phthalocyanine, metal free phthalocyanine, benzimidazole perylene, and the like and mixtures thereof are especially preferred because of their sensitivity to white light. Chloroindium phthalocyanine, vanadyl phthalocyanine, and metal free phthalocyanine are also preferred because these materials provide the additional benefit of being sensitive to infrared light.

The most preferred charge generating layer of the photoreceptor of this invention comprises a perylene pigment. Any suitable perylene charge generating material may be employed. Known perylene compositions illustrated herein are generally prepared by the condensation reaction of perylene 3,4,9,10 tetracarboxylic acid or the corresponding anhydrides with an appropriate amine in quinoline, in the presence of a catalyst, and with heating at elevated temperatures, about 180° C. to about 230° C., the details of which are described in German Patent Publications Nos. 2,451,780; 2,451,781; 2,451,782; 2,451,783; 2,451,784; 3,016,765; French Patent No. 7723888; and British Patent Nos. 857,130; 901,694; and 1,095,196, the entire disclosure of each of the aforementioned publications and patents being incorporated herein by reference.

In one specific process embodiment, the perylene pigments can be prepared by the condensation reaction of the perylene-3,4,9,10-tetracarboxylic acid or its corresponding anhydrides with an amine in a molar ratio of from about 1:2 to about 1:10, and preferably in a ratio of from about 1:2 to about 1:3. This reaction is generally accomplished at a temperature of from about 180° C. to about 230° C., and preferably at a temperature of about 210° C. with stirring and in the presence of a catalyst. Subsequently, the desired product is isolated from the reaction mixture by known techniques such as filtration. Examples of reactants include perylene-3,4,9,10-tetracarboxylic acid, and perylene-3,4,9,10-tetracarboxylic acid dianhydride. Illustrative amine reactants include o-phenylene diamine 2,3-diaminonaphthalene; 2,3-diamino pyridine; 3,4-diamino pyridine; 5,6-diamino pyrimidene; 9,10-diamino phenanthrene; 1,8-diamino naphthalene; aniline; and substituted anilines.

Catalysts that can be used include known effective materials such as anhydrous zinc chloride, anhydrous zinc acetate, zinc oxide, acetic acid, hydrochloric acid, and the like.

The perylene pigment is preferably benzimidazole perylene which is also referred to as bis(benzimidazole). This pigment exists in the cis and trans forms. The cis form is also called bis-benzimidazo(2,1-a-1',1'-b) anthra (2,1,9-def:6,5,10-d'e'f') disoquinoline-6,11-dione. The trans form is also called bisbenzimidazo (2,1-a1',1'-b) anthra (2,1,9-def:6,5,10-d'e'f') disoquinoline-10,21-dione. This pigment may be prepared by reacting perylene 3,4,9,10-tetracarboxylic acid dianhydride with 1,2-phenylene as illustrated in the following reaction equation:

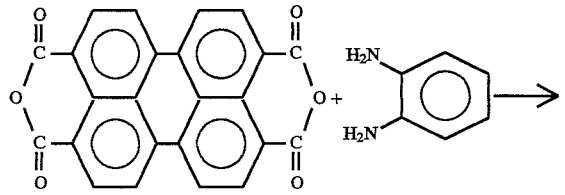

Perylene 3,4,9,10-tetracarboxylic acid dianhydride 1,2-phenylene

-continued

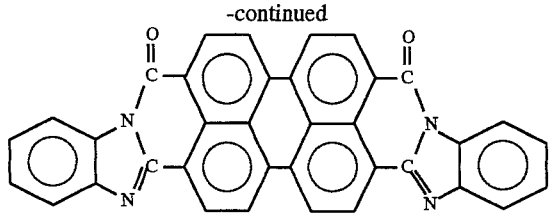

CIS bisbenzimidazo(2,1-a-1',1'-b)anthra(2,1,9-def:6,5,10-d'e'f') diisoquinoline- 6,11-dione

+

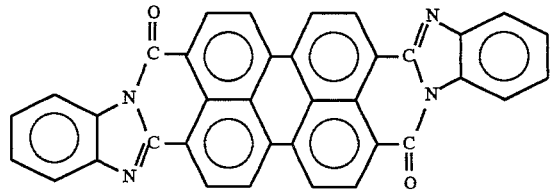

TRANS bisbenzimidazo(2,1-a-1',1'-b)anthra(2,1,9-def:6,5,10-d'e'f') diisoquinoline-10,21-dione Benzimidazole perylene is deposited as a thin homogeneous coating by vacuum sublimation deposition. In a typical vacuum sublimation deposition process, the benzimidazole perylene is heated in an inert boat to about 550° C. in a vacuum coater evacuated to a pressure of about $10^{-5}$ torr. The boat is spaced about 16 centimeters from the substrate to be coated. The vapor deposition of benzimidazole perylene can be conducted at a rate of about 4 Angstroms per second. Vacuum sublimation deposition of benzimidazole perylene is known in the art and disclosed, for example in U.S. Pat. No. 4,587,189, the entire disclosure thereof being incorporated herein by reference. Benzimidazole perylene is also described in U.S. Pat. No. 5,019,473, the entire disclosure thereof being incorporated herein by reference.

A satisfactory thickness for the thin vapor deposited organic charge generating layer consisting essentially of a homogeneous film of benzimidazole perylene is between about 0.05 micrometer and about 5 micrometers. The preferred thickness for the thin vapor deposited charge generating layer is between about 0.2 micrometer and about 3 micrometers. Optimum photoelectrical and mechanical results can be obtained when the charge generating layer has a thickness of between about 0.3 micrometer to about 1 micrometer. Thicknesses outside these ranges may be selected providing the objectives of the present invention are achieved.

Any suitable charge transport layer may be utilized. The active charge transport layer may comprise any suitable transparent organic polymer or non-polymeric material capable of supporting the injection of photo-generated holes and electrons from the charge generating layer and allowing the transport of these holes or electrons through the organic layer to selectively discharge the surface charge. The charge transport layer in conjunction with the generation layer in the instant invention is a material which is an insulator to the extent that an electrostatic charge placed on the transport layer is not conducted in the absence of illumination Thus, the active charge transport layer is a substantially nonphotoconductive material which supports the injection of photogenerated holes from the generation layer.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble. A dried charge transport layer containing between about 40 percent and about 50 percent by weight of the small molecule charge transport molecule based on the total weight of the dried charge transport layer is preferred.

The charge transport layer forming mixture preferably comprises an aromatic amine compound. Typical aromatic amine compounds include triphenyl amines, bis and poly triarylamines, bis arylamine ethers, bis alkyl-arylamines and the like.

Examples of charge transporting aromatic amines for charge transport layers capable of supporting the injection of photogenerated holes of a charge generating layer and transporting the holes through the charge transport layer include, for example, triphenylmethane, bis(4-diethylamine-2-methylphenyl)phenylmethane; 4'-4"-bis(diethylamino)-2', 2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis (chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Weight average molecular weights can vary from about 20,000 to about 1,500,000.

The preferred electrically inactive resin materials are polycarbonate resins have a weight average molecular weight from about 20,000 to about 120,000, more preferably from about 50,000 to about 100,000. The materials most preferred as the electrically inactive resin material is poly (4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G., a polycarbonate resin having a molecular weight of from about 20,000 to about 50,000 available as Merlon from Mobay Chemical Company, poly (4,4'-diphenyl-1,1'-cyclohexane carbonate).

Examples of photosensitive members having at least two electrically operative layers include the charge generator layer and diamine containing transport layer members disclosed in U.S. Pat. Nos. 4,265,990, 4,233,384, 4,306,008, 4,299,897 and 4,439,507. The disclosures of these patents are incorporated herein in their entirety.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers and about 100 micrometers, but thicknesses outside this range can also be used. A dried thickness of between about 18 micrometers and about 35 micrometers is preferred with optimum results being achieved with a thickness between about 24 micrometers and about 29 micrometers.

Preferably, the charge transport layer comprises an arylamine small molecule dissolved or molecularly dispersed in a polycarbonate.

Other layers such as conventional ground strips comprising, for example, conductive particles disposed in a film forming binder may be applied to one edge of the photoreceptor in contact with the conductive layer, blocking layer, adhesive layer or charge generating layer.

Optionally, an overcoat layer may also be utilized to improve resistance to abrasion. In some cases a back coating may be applied to the side opposite the photoreceptor to provide flatness and/or abrasion resistance. These overcoating and back coating layers may comprise organic polymers or inorganic polymers that are electrically insulating or slightly semi-conductive.

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

COMPARATIVE EXAMPLE I

A photoconductive imaging member was prepared by providing a web of titanium coated biaxially oriented polyethylene terephthalate substrate (Melinex, available from ICI Americas Inc.) substrate having a thickness of 3 mils, and applying thereto, with a gravure applicator using a production coater, a solution containing 50 grams 3-aminopropyltriethoxysilane, 15 grams acetic acid, 684.8 grams of 200 proof denatured alcohol and 200 grams heptane. This layer was then dried for about 5 minutes at 135° C. in the forced air drier of the coater. The resulting blocking layer had a dry thickness of 0.05 micrometer.

An adhesive interface layer was then prepared by the applying a wet coating over the blocking layer, using a gravure applicator, containing 0.5 percent by weight based on the total weight of the solution of copolyester adhesive (49,000, available from Morton Chemical Co., previously available from E.I. du Pont de Nemours & Co.) in a 70:30 volume ratio mixture of tetrahydrofuran/cyclohexanone. The adhesive interface layer was then dried for about 5 minutes at 135° C. in the forced air drier of the coater. The resulting adhesive interface layer had a dry thickness of 620 Angstroms.

A 0.7 micrometer thickness benzimidazole perylene charge generating pigment was vacuum sublimation deposited over the du Pont 49,000 adhesive layer from a heated crucible at a web speed of 6 feet per minute. The sublimation-deposition process was carried out in a vacuum chamber under about $4\times10^{-5}$ mm Hg pressure and a crucible temperature of about 550° C. During vapor deposition, the deposited benzimidazole perylene layer was at an elevated temperature whereas the adhesive coated substrate, being a good heat insulator and having a large mass compared to the deposited benzimidazole perylene, exhibited little or negligible temperature rise and remained essentially at low temperature. This benzimidazole perylene coated member was removed from the vacuum chamber and as it was cooled to ambient room temperature strain in the deposited benzimidazole perylene charge generating layer began to build up due to dimensional thermal contraction of the deposited benzimidazole perylene charge generating layer.

A 9 inch×12 inch sample was then cut from the web, and the benzimidazole perylene charge generating layer was overcoated with a charge transport layer. The charge transport layer coating solution was prepared by introducing into an amber glass bottle in a weight ratio of 1:1 N,N'-diphenyl-N,N'-bis(3-methylphenyl)-1,1'-biphenyl-4,4'-diamine and Makrolon 5705, a polycarbonate resin having a molecule weight of about 120,000 and commercially available from Farbenfabricken Bayer A.G. The resulting mixture was dissolved by adding methylene chloride to the glass bottle to form a 16 percent weight solid charge transport layer solution. This solution was applied onto the charge generating layer by hand coating using a 3 mil gap Bird applicator to form a wet coating which upon drying at 135° C. in an air circulation oven for 5 minutes gave a dried charge transport layer thickness of 24 micrometers. During the charge transport layer coating process, the humidity was controlled at or less than 15 percent.

Although the benzimidazole perylene charge generating layer is insoluble in methylene chloride (the solvent used for applying the charge transport layer coating solution), the application of the charge transport layer coating solution to the benzimidazole perylene charge generating layer allowed the solvent to penetrate through the thin charge generating layer to the adhesive layer beneath and caused dissolution of the adhesive layer. Without the anchor support of a solid adhesive layer, uneven planar contraction due to the built in internal strain within the benzimidazole perylene charge generating layer resulted in the formation of mud cracks in the benzimidazole perylene charge generating layer. The mud cracks were visible to the naked eye and also under 50× magnification using both reflection and transmission optical microscopes.

After application of the charge transport layer coating, the imaging member spontaneous curled upwardly. An anti-curl coating was needed to impart the desired flatness to the imaging member. The anti-curl coating solution was prepared in a glass bottle by dissolving 8.82 grams polycarbonate (Makrolon 5705, available from Bayer AG) and 0.09 grams copolyester adhesion promoter (Vitel PE-100, available from Goodyear Tire and Rubber Company) in 90.07 grams methylene chloride. The glass bottle was then covered tightly and placed on a roll mill for about 24 hours until total dissolution of the polycarbonate and the copolyester is achieved. The anti-curl coating solution thus obtained was applied to the rear surface of the supporting substrate (the side opposite to the imaging layers) by hand coating using a 3 mil gap Bird applicator. The coated wet film was dried at 135° C. in an air circulation oven for about 5 minutes to produce a dry, 14 micrometer thick anti-curl layer and provide the desired imaging member flatness. The resulting photoconductive imaging member was used to serve as a control.

EXAMPLE II

To demonstrate that the observed benzimidazole perylene charge generating layer mud cracking was due to the effect of internal tension strain release in the benzimidazole perylene charge generating layer as a result of solvent permeation to and dissolution of the adhesive layer rather than due to the effect of differential thermal contraction between the charge transport layer and the supporting substrate during the heating, drying and cooling processes, a piece of test sample of the adhesive coated polyethylene terephthalate substrate bearing the benzimidazole perylene charge generating layer described in Example I was tested for direct methylene chloride exposure without any application of a charge transport layer. Instantaneous mud cracking in the benzimidazole perylene charge generating layer was immediately visible, under a 100x magnification using a reflection optical microscope, as soon as a drop of methylene chloride was applied directly onto the charge generating layer of the test sample.

EXAMPLE III

Two test samples were prepared as described in Example II except that the 49,000 adhesive interface layer of each test sample was replaced with one of the two film forming thermoplastic urethanes (TPU), Elastollan® 1180A (polyether TPU) and Elastollan® C98A (polyester TPU), both available from BASF Corporation. These replacement adhesive layers for the test samples were prepared by forming two different solutions, each containing 0.5 weight percent of one of the polyurethanes, based on the total weight of the solution, dissolved in a solvent mixture containing a 70:30 volume ratio of tetrahydrofuran and cyclohexanone. The dried adhesive interface layer coating of the Elastollan 1180A® polyether TPU had a uniform thickness of about 452 Angstroms and the dried adhesive interface layer coating of the Elastollan® C98A polyester TPU had a uniform thickness of about 467 Angstroms. These test samples did not have an applied charge transport layer, but each did have a benzimidazole perylene charge generating layer vacuum sublimation deposited onto the film forming thermoplastic polyurethane adhesive interface layer. The test samples developed no sign of charge generation layer mud cracking upon direct exposure to methylene chloride. Selection of these Elastollan® thermoplastic polyurethane materials as an adhesive interface layer for a photoconductive imaging member of the present invention was based on their specific solvent resistance against methylene chloride contact, i.e. their insolubility in methylene chloride, the solvent used for applying the charge transport layer.

EXAMPLE IV

A photoconductive imaging member was prepared as described in Comparative Example I, except that the 49,000 adhesive interface layer was replaced with a film forming thermoplastic polyurethane, Elastollan® 1180A polyether TPU, available from BASF Corporation. This film forming thermoplastic urethane was applied as a solution containing 0.5 weight percent polyurethane, based on the total weight of the solution, dissolved in a solvent mixture containing a 70:30 volume ratio of tetrahydrofuran and cyclohexanone. The dried adhesive interface layer coating of the Elastollan® 1180A polyether TPU had a uniform thickness of about 461 Angstroms.

EXAMPLE V

A photoconductive imaging member was prepared as described in Example IV except that the adhesive interface layer was replaced with another film forming thermoplastic urethane, Elastollan® C98A polyester. After drying, the adhesive interface layer coating of the Elastollan® C98A polyester TPU had a uniform thickness of about 456 Angstroms.

COMPARATIVE EXAMPLE VI

A photoconductive imaging member was prepared as described in Comparative Example I, except that the 49,000 adhesive interface layer was replaced by a thermoset polyurethane coating. This polyurethane was Q-Thane® KR-4780, a humidity catalyzed aliphatic polyurethane available from K. P. Quinn & Company. The polyurethane is a one component, water clear liquid, consisting of 35 weight percent polyol and diisocyanate dissolved in toluene. The commercially available liquid was diluted with toluene to give a final solid content of about 0.5 weight percent, based on the total weight of the solution, prior to coating. The applied coating was dried at 135° C. for 5 minutes to remove the solvent. The resulting dried coating consisted of a three-dimensional crosslinked thermoset network having a uniform thickness of about 490 Angstroms.

COMPARATIVE EXAMPLE VII

A photoconductive imaging member was prepared as described in Comparative Example VI, except that the Q-Thane® KR-4780 polyurethane adhesive interface layer was replaced with a different type of thermoset polyurethane, Witcobond® W404 adhesive layer. Witcobond® W404 is a self-crosslinkable polyurethane, available from Witco Corporation, in the form of an aqueous dispersion of urethane globules where the globule size distribution was in a range of about 1,000 and 5,000 Angstroms. This commercially available Witcobond® W404 dispersion was diluted with isopropanol and then applied as a coating. After drying at 135° C. for 5 minutes to remove the solvents and to facilitate self-crosslinking, a dried thermoset polyurethane adhesive interface layer was formed which had a rough surface morphology and an approximate thickness of 496 Angstroms.

EXAMPLE VIII

A photoconductive imaging member was prepared as described in Example IV, except that the silane hole blocking layer was omitted. As in Example IV, the thermoplastic polyurethane Elastollan® 1180A polyether TPU was applied as a coating using a 0.5 weight percent solution, based on the total weight of the solution, of a solvent mixture containing a 70:30 volume ratio of tetrahydrofuran and cyclohexanone. The dried coating had a uniform thickness of about 446 Angstroms.

EXAMPLE IX

A photoconductive imaging member was prepared as described in Example VIII, except that the Elastollan® 1180A polyether TPU adhesive interface layer was applied as a coating using a 0.75 weight percent solution, based on the total weight of the solution. The dried coating had a uniform thickness of 649 Angstroms.

EXAMPLE X

A photoconductive imaging member was prepared as described in Example VIII, except that the Elastollan® 1180A polyether TPU adhesive interface layer was applied as a coating using a 1.0 weight percent solution, based on the total weight of the solution. The dried coating had a uniform thickness of about 977 Angstroms.

EXAMPLE XI

A photoconductive imaging member was prepared as described in Example VIII except that the Elastollan® 1180A polyether TPU adhesive interface layer was applied as a coating using a 1.5 weight percent solution, based on the total weight of the solution. The dried coating had a uniform thickness of about 1,530 Angstroms.

EXAMPLE XII

A photoconductive imaging member was prepared as described in Example VIII, except that the Elastollan® 1180 A polyether TPU adhesive interface layer was applied as a coating using a 2.0 weight percent solution, based on the total weight of the solution. The dried coating had a uniform thickness of about 2,066 Angstroms.

EXAMPLE XIII

A photoconductive imaging member was prepared as described in Example V, except that the silane hole blocking layer was omitted. As in Example V, the thermoplastic polyurethane Elastollan® C98A polyester TPU adhesive interface layer was applied as a coating on the titanium coated biaxially oriented polyethylene terephthalate substrate. The coating solution contained 0.75 weight percent thermoplastic polyurethane Elastollan® C98A polyester TPU, based on the total weight of the solution. The dried adhesive interface layer formed had a uniform thickness of about 682 Angstroms.

COMPARATIVE EXAMPLE XIV

A photoconductive imaging member was prepared as described in Comparative Example VI, except that the silane hole blocking layer was omitted and the dried thermoset polyurethane Q-Thane® KR-4780 adhesive interface layer had a thickness of about 715 Angstroms.

COMPARATIVE EXAMPLE XV

A photoconductive imaging member was prepared as described in Comparative Example VII, except that the silane hole blocking layer was omitted and the dried thermosett polyurethane Witcobond® W404 adhesive interface layer had a rough surface morphology and an approximate thickness of 507 Angstroms.

EXAMPLE XVI

The photoconductive imaging members of Control Example I and Examples IV through XV were evaluated for adhesive properties using a 180° (reverse) peel test technique. The 180° peel strength was determined by cutting a minimum of five 0.5 inch×6 inches imaging member samples from each of these Examples. For each sample, the charge transport layer is partially stripped from the test imaging member sample with the aid of a razor blade and then hand peeled to about 3.5 inches from one end to expose part of the underlying charge generating layer. The test imaging member sample is secured with its charge transport layer surface toward a 1 inch×6 inches×0.5 inch aluminum backing plate with the aid of two sided adhesive tape, 1.3 cm (½ inch) width Scotch® Magic Tape #810, available from 3M Company. At this condition, the anti-curl layer/substrate of the stripped segment of the test sample can easily be peeled away 180° from the sample to cause the adhesive layer to separate from the charge generating layer. The end of the resulting assembly opposite to the end from which the charge transport layer is not stripped is inserted into the upper jaw of an Instron Tensile Tester. The free end of the partially peeled anti-curl/substrate strip is inserted into the lower jaw of the Instron Tensile Tester. The jaws are then activated at a 1 inch/min crosshead speed, a 2 inch chart speed and a load range of 200 grams to 180° peel the sample at least 2 inches. The load monitored with a chart recorder is calculated to give the peel strength by dividing the average load required for stripping the anti-curl layer with the substrate by the width of the test sample.

All of the of the photoconductive imaging members were also examined under a 100× magnification, using an optical transmission microscope, for any evidence of mud cracking in the charge generating layer.

Both the adhesion measurement results and the results obtained during examination for mud cracking are collectively summarized in Table A below:

TABLE A

| EXAMPLE | ADHESIVE LAYER (A°) | 180° REV. PEEL (9 ms/cm) | CGL CRACKING |
|---|---|---|---|
| I Control | 600 | 5.9 | Yes |
| IV TPU | 461 | 19.7 | No |
| V TPU | 456 | 11.2 | No |
| VI Q-Thane | 690 | 7.2 | No |
| VII Witcobond | 496 | 6.1 | No |
| VIII TPU | 446 | 18.9 | No |
| IX TPU | 649 | 25.2 | No |
| X TPU | 977 | 44.1 | No |
| XI TPU | 1530 | 109.0 | No |
| XII TPU | 2066 | 120.0 | No |
| XIII TPU | 682 | 14.2 | No |
| XIV Q-Thane | 715 | 8.9 | No |
| XV Witcobond | 507 | 4.3 | No |

The adhesion measurement results, obtained by the reversed peel test technique for all the imaging member samples show that the adhesive strength of the imaging member sample of Example I could be substantially increased by up to twenty times when the 49,000 polyester adhesive interface layer was substituted by the linear thermoplastic polyurethane adhesive layer of this invention. Furthermore, photoconductive imaging member structure simplification achieved by omitting the silane hole blocking layer coupled with 49,000 adhesive interface layer substitution of the dual layers with the single themoplastic polyurethane layer of this invention yielded significant improvement in adhesion. In contrast, it was found that the use of thermoset polyurethane (either Q-Thane® or Witcobond) adhesive interface layer counterparts did not yield the adhesion enhancement seen for the thermoplastic polyurethane. Although mud cracks were found in the control photoconductive imaging member of Example I, no mud cracks were observed in any of the imaging member samples using either a thermoplastic or thermoset polyurethane adhesive interface layer indicating resistance to methylene chloride is the key to resolve the charge generating layer mud cracking problem.

EXAMPLE XVII

The electrical properties of duplicates of the photoconductive imaging member samples used for adhesion measurements described above were evaluated with a xerographic testing scanner comprising a cylindrical aluminum drum having a diameter of 24.26 cm (9.55 inches). The test samples were taped onto the drum. When rotated, the drum carrying the samples produced a constant surface speed of 76.3 cm (30 inches) per second. A direct current pin corotron, exposure light, erase light, and five electrometer probes were mounted around the periphery of the mounted photoreceptor samples. The sample charging time was 33 milliseconds. Both expose and erase lights were broad band white light (400–700 nm) outputs, each supplied by a 300 watt output Xenon arc lamp. The relative locations of the probes and lights are indicated in Table B below:

TABLE B

| ELEMENT | ANGLE (Degrees) | POSITION (mm) | DISTANCE FROM PHOTORECEPTOR (mm) |
|---|---|---|---|
| Charge | 0.0 | 0.0 | 18 (Pins)<br>12 (Shield) |
| Probe 1 | 22.50 | 47.9 | 3.17 |
| Expose | 56.25 | 118.8 | N.A. |
| Probe 2 | 78.75 | 166.8 | 3.17 |
| Probe 3 | 168.75 | 356.0 | 3.17 |
| Probe 4 | 236.25 | 489.0 | 3.17 |
| Erase | 258.75 | 548.0 | 125.00 |
| Probe 5 | 303.75 | 642.9 | 3.17 |

The test samples were first rested in the dark for at least 60 minutes to ensure achievement of equilibrium with the testing conditions at 40 percent relative humidity and 21° C. Each sample was then negatively charged in the dark to a development potential of about 900 volts. The charge acceptance of each sample and its residual potential after discharge by front erase exposure to 400 ers/cm$^2$ were recorded. The test procedure was repeated to determine the photo induced discharge characteristic (PIDC) of each sample by different light energies of up to 20 ergs/cm$^2$.

Although the electrical results obtained showed that a 49,000 adhesive interface layer replaced by either a thermoplastic or a thermoset polyurethane did not alter the photoelectrical integrity of the photoconductive imaging member, an undesirably large degree of electrical cycle-down was observed when imaging member simplification was carried out with omission of a silane blocking layer coupled with the 49,000 polyester substitution by of a single thermoset polyurethane (either Q-Thane® or Witcobond®) adhesive interface layer. In contrast, imaging member structure simplification employing a thermoplastic polyurethane adhesive interface layer of this invention did not produce any deleterious electrical impact on the resulting photoconductive imaging member.

While the embodiment disclosed herein is preferred, it will be appreciated from this teaching that various alternative, modifications, variations or improvements therein may be made by those skilled in the art, which are intended to be encompassed by the following claims.

What is claimed is:

1. An electrophotographic imaging member comprising a substrate layer having an electrically conductive outer surface, an adhesive layer comprising a thermoplastic polyurethane film forming resin represented by the following formula:

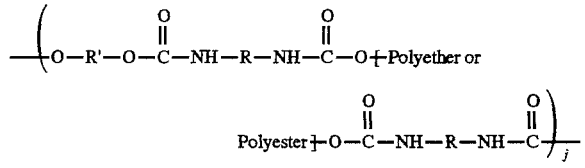

wherein:

R is diphenyl substituted methylene group or dicyclohexyl substituted methylene group, R' is a straight alkyl chain hydrocarbon containing between 2 and 6 carbon atoms, and j is, the degree of polymerization, between 90 and 500, a charge generation layer consisting essentially of a thin homogeneous vacuum sublimation deposited film of a photogenerating pigment and a charge transport layer, said transport layer being substantially non-absorbing in said spectral region at which said charge generation layer generates and injects photogenerated holes but being capable of supporting said injection of photogenerated holes from said charge generation layer and transporting said holes through said charge transport layer.

2. An electrophotographic imaging member according to claim 1 wherein said polyester is derived from a difunctional polyester polyol represented by the following formula:

$$HO\left(CH_2\right)_y\left[O-\overset{O}{\overset{\|}{C}}\left(CH_2\right)_z\overset{O}{\overset{\|}{C}}-O\left(CH_2\right)_y\right]_n-OH$$

wherein:

y is a number from 2 and 10, z is a number from 4 to 10, and n is a number from 15 to 30.

3. An electrophotographic imaging member according to claim 1 wherein said polyester is derived from a difunctional polyester polycaprolactone polyol represented by the following formula:

$$HO\left(CH_2\right)_y O\left[\left(CH_2\right)_5\overset{O}{\overset{\|}{C}}-O\right]_n\left(CH_2\right)_y OH$$

wherein:

y is a number from 2 to 10 and n is a number from 15 to 30.

4. An electrophotographic imaging member according to claim 1 wherein said polyether is derived from a difunctional polyether polyol represented by the following structural formula:

$$HO\left(CH_2\right)_x\left(O\left(CH2\right)_x\right)_m OH$$

wherein:

x is a number from 2 to 10 and m is a number from 10 to 20.

5. An electrophotographic imaging member according to claim 1 wherein said thermoplastic polyurethane film forming resin is free of any cross linking.

6. An electrophotographic imaging member according to claim 1 wherein said thermoplastic polyurethane film forming resin is a polymer chain comprising hard and soft segments.

7. An electrophotographic imaging member according to claim 1 wherein the weight ratio between said hard segments and said soft segment in said polymer chain is from about 75/25 to about 15/85.

8. An electrophotographic imaging member according to claim 1 wherein said adhesive layer has a thickness between about 0.01 micrometer and about 2 micrometers.

9. An electrophotographic imaging member according to claim 1 wherein said adhesive layer is in direct contact with said electrically conductive outer surface.

10. An electrophotographic imaging member according to claim 1 wherein a hole blocking layer is interposed between said adhesive layer and said electrically conductive outer surface.

11. An electrophotographic imaging member according to claim 10 wherein a hole blocking layer comprises a siloxane.

12. An electrophotographic imaging member according to claim 1 wherein said photogenerating pigment comprises benzimidazole perylene.

13. A process for fabricating a flexible electrophotographic imaging member comprising providing a flexible substrate layer having an electrically conductive outer surface, forming an adhesive layer comprising a solvent soluble thermoplastic polyurethane film forming resin represented by the following formula:

$$-\left(O-R'-O-\overset{O}{\overset{\|}{C}}-NH-R-NH-\overset{O}{\overset{\|}{C}}-O\right.\text{Polyether or}$$

$$\left.\text{Polyester}\right)-O-\overset{O}{\overset{\|}{C}}-NH-R-NH-\overset{O}{\overset{\|}{C}}\Big)_j$$

wherein:

R is diphenyl substituted methylene group or dicyclohexyl substituted methylene group, R' is a straight alkyl chain hydrocarbon containing between 1 and 10 carbon atoms, and j is, the degree of polymerization, between 90 and 500, vacuum sublimation depositing on said adhesive layer a thin charge generation layer consisting essentially of a thin, uniform homogeneous film of photoconductive pigment, and applying to said charge generation layer a charge transport coating comprising a film forming binder and a solvent for said film forming binder, said thermoplastic polyurethane of said adhesive layer being insoluble in said solvent, and drying said charge transport coating to form a charge transport layer.

14. A process for fabricating a flexible electrophotographic imaging member according to claim 13 wherein said polyester is derived from a difunctional polyester polyol represented by the following formula:

$$HO\left(CH_2\right)_y\left[O-\overset{O}{\overset{\|}{C}}\left(CH_2\right)_z\overset{O}{\overset{\|}{C}}-O\left(CH_2\right)_y\right]_n-OH$$

wherein:

y is a number from 2 and 10, z is a number from 4 to 10, and n is a number from 15 to 30.

15. A process for fabricating a flexible electrophotographic imaging member according to claim 13 wherein said polyester is derived from a difunctional polycaprolactone polyester polyol represented by the following formula:

$$HO\left(CH_2\right)_y O\left[\left(CH_2\right)_5\overset{O}{\overset{\|}{C}}-O\right]_n\left(CH_2\right)_y OH$$

wherein:

y is a number from 2 and 10 and n is a number from 15 to 30.

16. A process for fabricating a flexible electrophotographic imaging member according to claim 13 wherein said polyether is derived from a difunctional polyether polyol represented by the following structural formula:

$$HO\left(CH_2\right)_x\left[O\left(CH2\right)_x\right]_mOH$$

wherein:

x is a number from 2 to 10 and m is a number from 10 to 20.

17. A process for fabricating a flexible electrophotographic imaging member according to claim 13 wherein said thermoplastic polyurethane film forming resin is free of any cross linking.

18. A process for fabricating a flexible electrophotographic imaging member according to claim 13 wherein said polyurethane film forming resin is a reaction product of a diisocyanate, a difunctional diamine, and a linear difunctional polyol selected from the group consisting of polyether polyol and a polyester polyol.

19. A process for fabricating a flexible electrophotographic imaging member according to claim 13 including applying said adhesive layer directly to said electrically conductive outer surface.

20. A process for fabricating a flexible electrophotographic imaging member according to claim 13 including forming a hole blocking layer between said electrically conductive outer surface and said adhesive layer.

21. A process for fabricating a flexible electrophotographic imaging member according to claim 13 wherein said photogenerating pigment comprises benzimidazole perylene.

* * * * *